US006224029B1

(12) United States Patent
Marble et al.

(10) Patent No.: US 6,224,029 B1
(45) Date of Patent: May 1, 2001

(54) PORTABLE, ADJUSTABLE COUNTER APPARATUS

(76) Inventors: Jeanette L. Marble; William D. Marble, both of 39516 Diego Dr., Temecula, CA (US) 92591

( * ) Notice: Subject to any disclaimer, the term of this patent is extended or adjusted under 35 U.S.C. 154(b) by 0 days.

(21) Appl. No.: 09/275,484

(22) Filed: Mar. 24, 1999

Related U.S. Application Data

(60) Provisional application No. 60/079,986, filed on Mar. 30, 1998.

(51) Int. Cl.[7] ..... A47B 96/06

(52) U.S. Cl. ..... 248/214; 248/235; 297/217.7

(58) Field of Search ..... 108/152, 47, 144, 108/149, 106; 248/240, 241, 243, 240.3, 235, 236, 214, 218.4, 219.3, 219.4; 297/217.7, 256, 14

(56) References Cited

U.S. PATENT DOCUMENTS

| | | | | |
|---|---|---|---|---|
| D. 251,357 | | 3/1979 | Chasen | D8/381 |
| D. 270,034 | | 8/1983 | Shepard | D8/381 |
| 626,641 | * | 6/1899 | Vaughan | 108/152 X |
| 1,010,812 | * | 12/1911 | Shuttleworth | 297/151 |
| 1,270,738 | * | 6/1918 | Jones | 297/256 |
| 2,497,658 | * | 2/1950 | Davis | 297/152 |
| 2,503,602 | * | 4/1950 | Titley | 108/47 X |
| 3,050,355 | * | 8/1962 | Hess | 108/149 X |
| 3,465,893 | * | 9/1969 | Kinney | 108/149 X |
| 4,138,019 | | 2/1979 | Smith | 211/87 |
| 4,949,924 | | 8/1990 | Carmody | 248/215 |
| 5,009,380 | | 4/1991 | Fee | 248/214 |
| 5,052,648 | * | 10/1991 | Landau | 248/235 |
| 5,267,715 | | 12/1993 | Owen | 248/235 |
| 5,427,344 | * | 6/1995 | Beauchemin | 248/218.4 |

* cited by examiner

*Primary Examiner*—Leslie A. Braun
*Assistant Examiner*—Gwendolyn Baxter

(57) ABSTRACT

A portable, adjustable shelf apparatus comprises a shelf having a front edge, a rear edge and side edges. A back member is fixed to the upper surface of the shelf adjacent the shelf rear edge. Included are first and second elongate, slender shelf-hanging chains, each having first and second end regions. First end regions of each of the first and second chains are secured to an under surface of the shelf adjacent the shelf front edge in a spaced apart relationship. Eye screws are installed into the shelf from the under surface of the shelf adjacent the shelf rear edge. Split rings are included for detachably attaching the second end region of each of the chains to the eye screws to thereby enable the shelf to be hung securely from an upper railing of a balustrade at any desired height. Plastic sleeves are installed over at least regions of the chains to protect railings from which the shelf is hung. Side rails may be installed along front and side edges of the shelf to retain objects on the shelf.

3 Claims, 3 Drawing Sheets

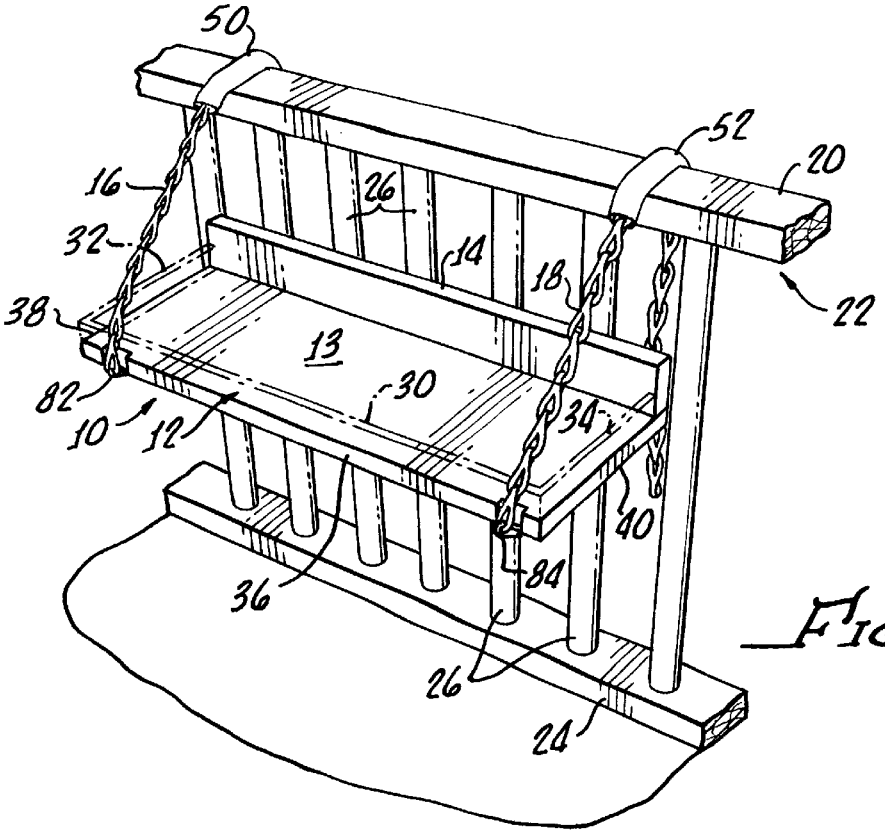
FIG. 1.
FIG. 2.
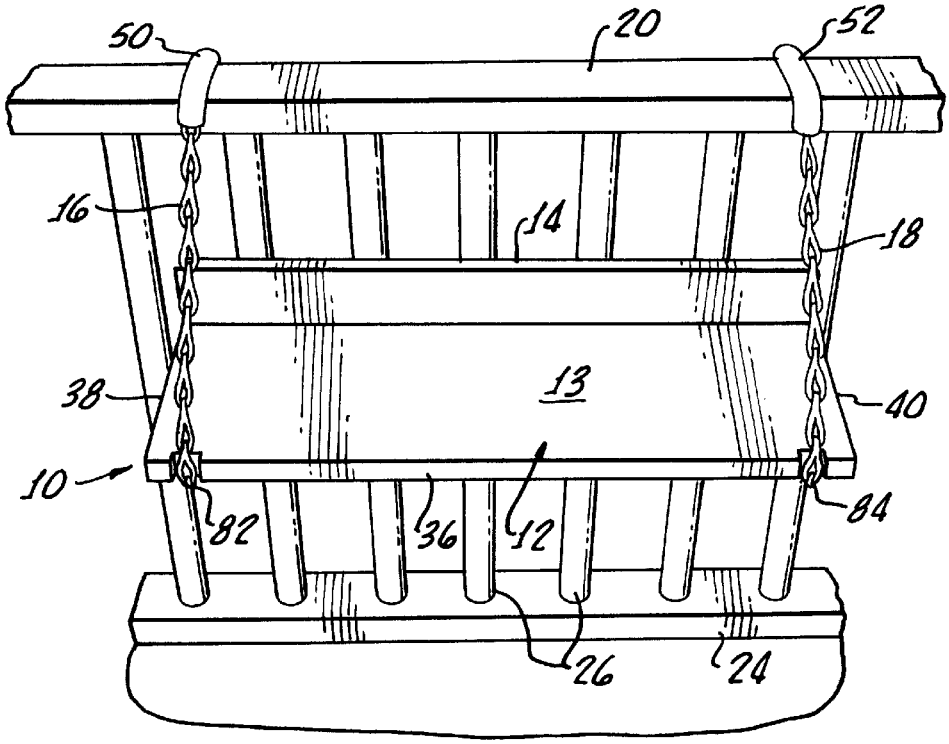

PORTABLE, ADJUSTABLE COUNTER APPARATUS

This application is a continuation of provisional application No. 60/079,986, filed Mar. 30, 1998.

BACKGROUND OF THE INVENTION

1. Field of the Invention

The present invention relates generally to the field of shelves, more particularly to hanging shelves, and still more particularly to shelves associated with balustrades around patios, balconies, decks and the like.

2. Background Discussion

It is known that patios, balconies, decks and the like, particularly those provided with apartments and condominiums are often relatively small with little room for plants and eating tables. Consequently it is not unusual for occupants to attach shelves or counters to balustrades around the patios, decks or balconies.

As examples, U.S. Pat. No. 4,949,924 to Burr T. Carmody discloses a support fixture for mounting on railings and the like and U.S. Pat. No. 5,009,380 to Thomas G. Fee discloses a rail mounted rack for such containers as outdoor grills and the like. Further U.S. Pat. No. 5,267,715 to James D. Owen discloses a patio railing shelf bracket.

One of the problems typically associated with such fixtures, racks or brackets is their lack of flexibility concerning the attachment, location and height of installation and the width of the railing to which they are intended to be attached and/or their lack of versatility of use.

For these and other reasons, the present inventor has invented an improved and attractive shelf or counter which is easily attached to and detached from balustrade railings of any reasonable width, which can be easily adjusted for height from the top of the railing, and which can be used for such diverse purposes as holding potted plants, for an eating table, and for a convenience shelf.

SUMMARY OF THE INVENTION

In accordance with the present invention, there is provided a portable, adjustable shelf or counter apparatus for hanging from a balustrade or the like, said apparatus comprising a shelf having a front edge, a back edge and side edges. Included are first and second elongate, flexible hanging elements each having first and second end regions and securing means for securing the first end region of each of the first and second hanging elements to the shelf adjacent the shelf front edge in a spaced apart relationship. Attaching means are provided for detachably attaching the second end region of each of the first and second hanging elements to the shelf adjacent the shelf rear edge in the spaced apart relationship. A back member is fixed to the shelf adjacent the back edge.

The securing means secures the first end regions of the first and second hanging elements to an under surface of the shelf adjacent the shelf front edge. The attaching means detachably attaches the second end regions of the first and second hanging elements to an under surface of the shelf adjacent the shelf rear edge.

In accordance with a preferred embodiment of the invention there are included first and second protective sleeves slidingly installed over at least portions of respective first and second hanging elements. Preferably, the protective sleeves comprise plastic tubing.

There may be included edge rails installed on an upper surface of said shelf adjacent said front and side edges to retain objects on the shelf.

Preferably, the first and second hanging elements comprise metal chains, and the attaching means include eye screws attached to an under side of the shelf adjacent said shelf side edges and further include split rings for detachably attaching each of the first and second hanging elements to respective ones of the eye screws.

The shelf apparatus can then be conveniently hung from an upper railing of a balustrade at any desired height and can be conveniently moved from one location to another as may be desired.

Furthermore, the apparatus of the present invention is attractive and is easy to manufacture.

BRIEF DESCRIPTION OF THE DRAWINGS

The present invention can be more readily understood by a consideration of the following detailed description when taken in conjunction with the accompanying drawings, in which:

FIG. 1 is a perspective drawing of the adjustable-height hanging shelf or counter apparatus in accordance with a preferred embodiment of the present invention, showing the shelf or counter hanging by a spaced-apart pair of small chains from the top railing of an exemplary section of balustrade, with a back member of the shelf bearing against balusters of the balustrade;

FIG. 2 is a front view of the hanging shelf or counter of FIG. 1, showing additional features thereof, including the pair of chain hangers attached to the shelf or counter;

In the various FIGS., the same elements and features are given the same reference numbers

DESCRIPTION OF THE PREFERRED EMBODIMENT

Figure 3:
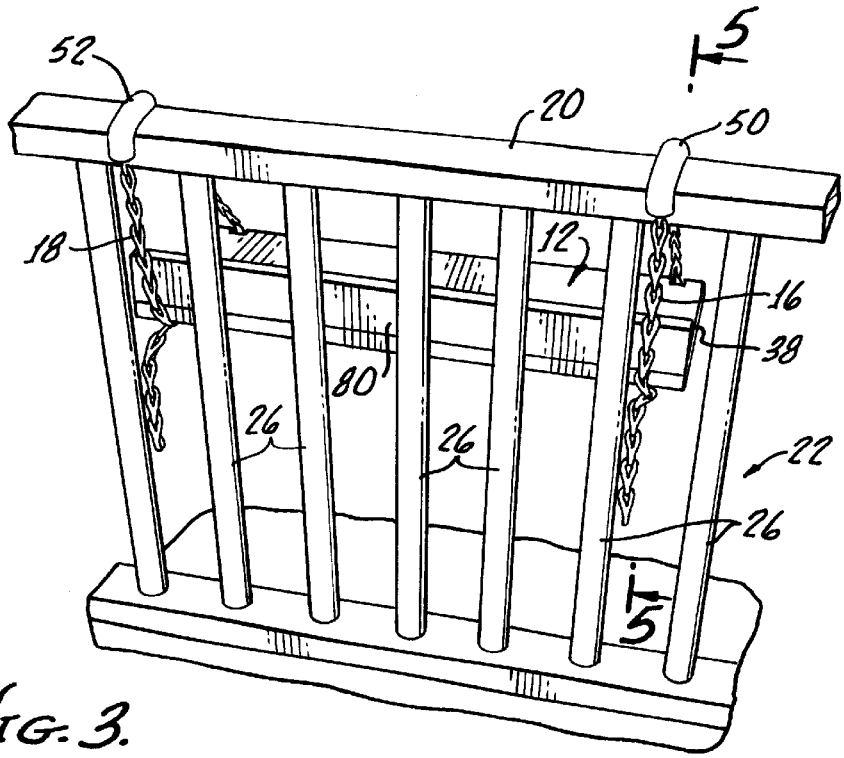
FIG. 3 is a rear view of the hanging shelf or counter of FIG. 1, showing additional features thereof, including the pair of chain hangers attached to the shelf or counter.
Figure 4:
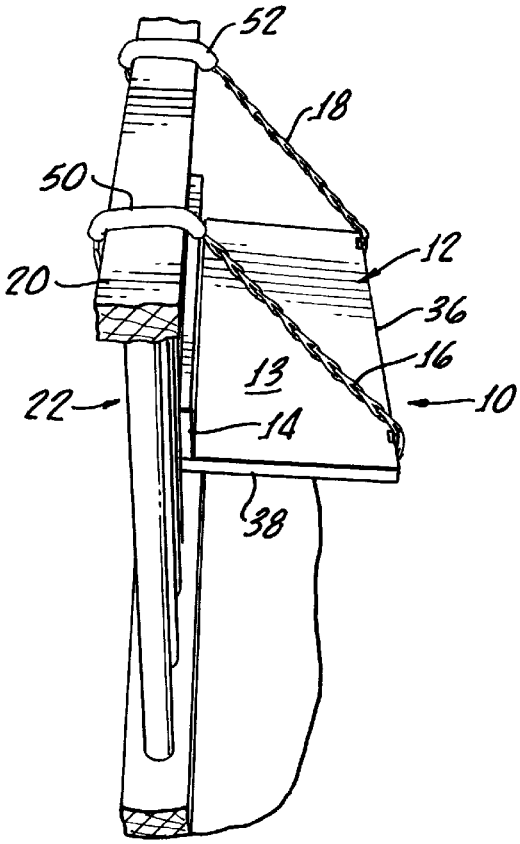
FIG. 4 is a side view of the hanging shelf or corner of FIG. 1, showing additional features thereof, including the pair of chain hangers attached to the shelf or counter.

There is shown in FIG. 1, a portable, adjustable shelf or counter apparatus 10 in accordance with a preferred embodiment of the present invention. Although reference hereinafter will usually be made to a hanging shelf for ease of description, it is to be understood that the term "shelf" is to be broadly construed to include any shelf-like member, such as a plant stand, an eating counter, a work table, a writing desk, a bench or the like.

Shown comprising shelf or counter apparatus 10 are a shelf 12 having fixed to an upper surface 13 thereof a back member 14. Included are first and second hanging elements 16 and 18 for hanging the shelf from an upper, horizontal railing 20 of an exemplary balustrade 22, only a short section of which is shown. Forming balustrade 22 (which forms no part of the present invention) are a lower, horizontal member 24 and several spaced apart balusters or vertical railing supports 26 installed between the upper railing and the lower member.

Shown in phantom lines in FIG. 1 are a front and first and second narrow retaining edge rails or turned up lips or elements 30, 32 and 34, respectively, which may be attached to or formed as part of respective front, first and second edge regions 36, 38 and 40 of shelf 12. Edge rails 30, 32 and 34, which are shown only on FIG. 1, may, if desired, be fixed to upper surface 13 of shelf 12 to form part thereof in order to retain articles such as potted plants, utensils, dishes and books (none of which are shown) on the shelf in the event the shelf is unintentionally displaced, for example, by being accidentally bumped or in the event of an earth trembler. It is to be understood, however, that rails 30, 32 and 34 may not always be provided-thus they are not shown in FIGS. 2–5.

Described further, first and second hanging elements 16 and 18, which together constitute shelf hanging means, preferably comprise an elongate, flexible chain, which for most shelves 12 may be of a strong, yet relatively lightweight link type that is commercially available at most hardware stores.

Preferably, at least rail contact regions of hanging elements 16 and 18 that extend over upper railing 20 are covered by tough, flexible plastic protective sleeves 50 and 52, respectively. Protective sleeves 50 and 52, which may advantageously comprise sections of flexible plastic tubing of the type available in many hardware stores for watering and/or water fountain use, are selected in size to slide along hanging elements 16 and 18 as required to protect railing 20 from being damaged or marring by hanging elements 16 and 18.

Figure 5:
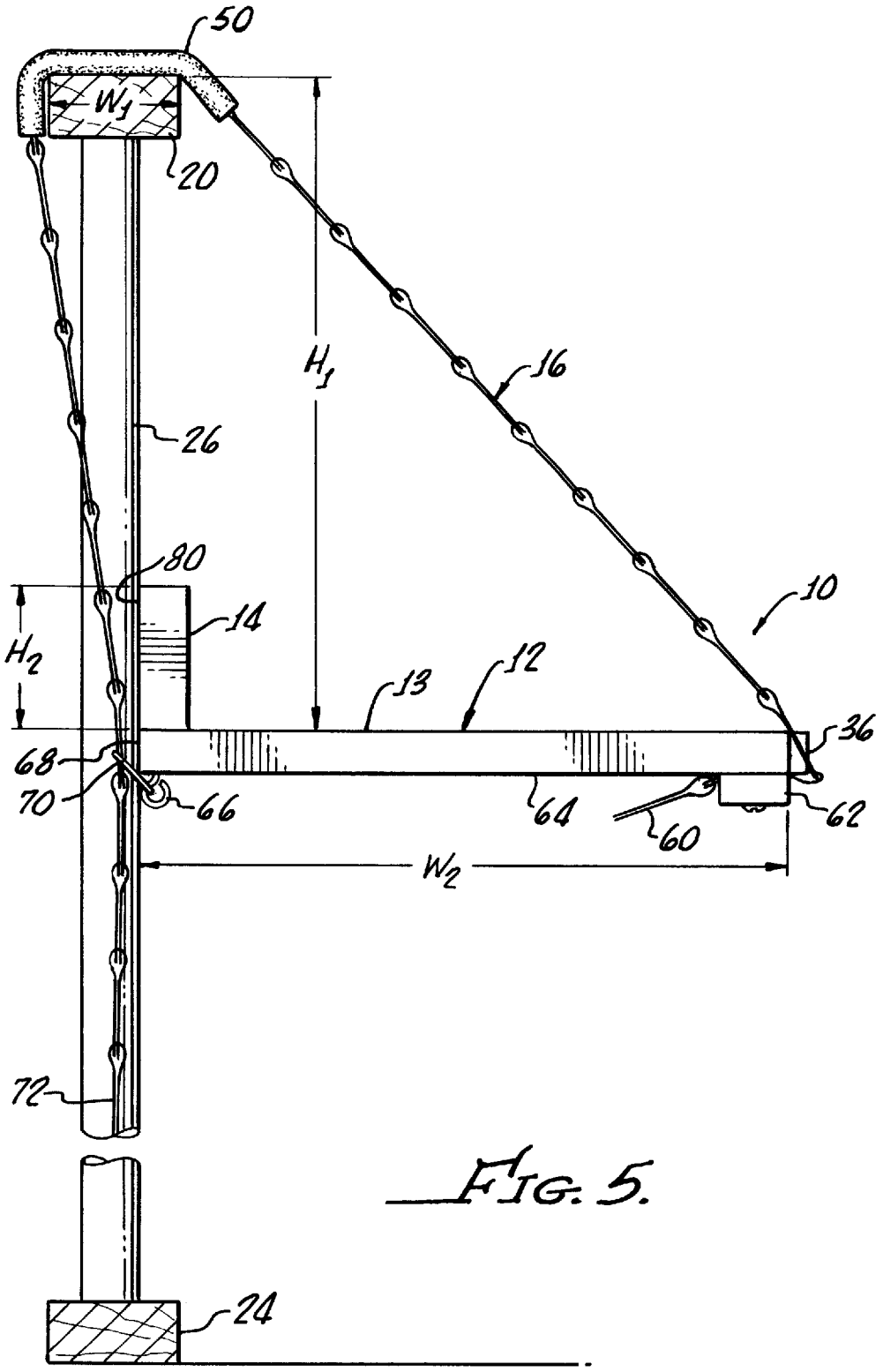
FIG. 5 is a vertical cross sectional view taken along line 5—5 of FIG. 3 showing in detail attachment of a representative one of the pair of hanging chains to the shelf or counter.

Hanging element 16 and 18 are attached to shelf 12 in the manner shown for representative first element 16 depicted in FIG. 5. A first end region 60 of element 16 is fixed securing means 62, for example, a screw, to an under surface 64 of shelf 12 at front edge 36 and adjacent side edge 38 (e.g., see FIG. 2). Installed in shelf 12, from under surface 64 thereof adjacent a rear edge 68 of the shelf and in alignment with screw 62, is a small eyebolt 66. A generally vertical, lower region 68 of element 16 is detachably attached in a secure manner to eyebolt 66, for example, by attachment means 70, for example, a conventional split ring. As an alternative to making the attachment by split ring, a spring-loaded connector (not shown) such as is used on pet leashes may be used. Hanging elements 16 and 18 may be made of plastic, brass, copper or any other metal.

In any event, attachment means 70 readily attaches element region 68 to eyebolt 66 at any location depending upon the desired hanging height, H, of shelf 12 from railing 20. Element 16 is therefore made of sufficient length to enable shelf 12 to be hung from any railing 20 of reasonable width, $W_1$, and to permit the shelf to be hung at any usable desired height, $H_1$, from the railing. As shown, a second end portion 72 of element 16 hangs, under gravity, out of the way, below shelf rear edge 68.

When elements 16 and 18 are attached to shelf 12 in the manner described above for element 16, shelf rear edge and a rear surface 80 of back member 14 bear against balusters 26 to provide additional support for the shelf (FIGS. 3 and 5).

Ordinarily, only one pair of elements 16 and 18 are needed for most shelves that are less than about five feet long. For shelves 12 longer than about five feet, one or more additional elements like 16 and 18 may be used.

Shelf 12 is preferably made having a width, $W_2$, between about twelve and about eighteen inches, but may be made more narrow or wider, according to intended use. Back member 14 preferably has a height, $H_2$, of about three to five inches, but may be made having a greater or lesser height. Shelf 12 and back member 14 (as may edge rails 32, 34 and 36, if used) may be constructed from wood, plastic, metal, or any combination thereof and may be finished in any desired manner. Shelf front edge 36 may, as best shown in FIGS. 1 and 2, be formed having notches 82 and 84 to recess respective elements 16 and 18.

It is apparent from the foregoing that detachable attachment means 70 can easily be detached from elements 16 and 18 or eyebolts 66 to enable shelf apparatus 10 to be relocated, for example, if the occupant of a dwelling where apparatus 10 is used moves elsewhere or merely wants to relocate the apparatus. Moreover, shelf apparatus 10 is economical to manufacture, is attractive, and is versatile in use.

Although there has been described above a portable, adjustable shelf or counter apparatus for hanging in a height-adjustable relationship from a balustrade railing in accordance with the present invention for purposes of illustrating the manner in which the present invention maybe used to advantage, it is to be understood that the invention is not limited thereto. Consequently, any and all variations and equivalent arrangements which may occur to those skilled in the applicable art are to be considered to be within the scope and spirit of the invention as set forth in the claims which are appended hereto as part of this application.

What is claimed is:

1. A portable, adjustable shelf apparatus for hanging from a balustrade or railing, said apparatus comprising:

a. a shelf having a front edge, a rear edge and side edges, and having an upper surface and a lower surface;

b. a back member fixed to said shelf adjacent said rear edge, and extending upwardly from said upper surface;

c. first and second elongate, flexible hanging elements each having first and second end regions, each of said elements comprising a strong, slender chain and each of said elements having a length adapted to extend up and over the balustrade or railing from which said apparatus is to be hung;

d. securing means for securing said first end region of each of said first and second flexible hanging elements to said under surface of said shelf adjacent said shelf front edge in a spaced apart relationship; and e. attaching means for detachably attaching said second end region of each of said first and second flexible hanging elements to said shelf adjacent said shelf rear edge in said spaced apart relationship, said attaching means including eye screws attached to said lower surface of the shelf adjacent said side edges and including split rings for detachably attaching each of said first and second flexible hanging elements to a respective ones of said eye screws.

2. A portable, adjustable shelf apparatus for hanging from a balustrade or railing, said apparatus comprising:

a. a shelf having a front edge, a rear edge and side edges, and having an upper surface and a lower surface;

b. a back member fixed to said shelf adjacent said rear edge, and extending upwardly from said upper surface;

f. first and second elongate, slender flexible hanging chains, each having first and second end regions, and each of said chains having a length sufficient to extend up and over a balustrade or railing from which said apparatus is to be hung;

c. securing means for securing said first end region of each of said first and second flexible hanging chains to said under surface of said shelf adjacent said shelf front edge in a spaced apart relationship;

d. attaching means for detachably attaching said second end region of each of said first and second flexible hanging chains to said under surface of said shelf adjacent said shelf rear edge in said spaced apart relationship; and e. first and second protective plastic tubing sleeves slidingly installed over at least portions of respective ones of said first and second flexible hanging chains.

3. The portable, adjustable shelf apparatus as claimed in claim 2, including edge rails installed on said upper surface of said shelf adjacent said front and side edges.

* * * * *